US007398662B2

(12) United States Patent
Kim et al.

(10) Patent No.: US 7,398,662 B2
(45) Date of Patent: Jul. 15, 2008

(54) GASKET AND WASHING MACHINE USING THE SAME

(75) Inventors: Jae Kyum Kim, Gimhae-si (KR); Ho Cheol Kwon, Changwon-si (KR); Kang Mo Choi, Masan-si (KR)

(73) Assignee: LG Electronics Inc., Seoul (KR)

( * ) Notice: Subject to any disclaimer, the term of this patent is extended or adjusted under 35 U.S.C. 154(b) by 476 days.

(21) Appl. No.: 10/722,455

(22) Filed: Nov. 28, 2003

(65) Prior Publication Data

US 2004/0103693 A1 Jun. 3, 2004

(30) Foreign Application Priority Data

Nov. 29, 2002 (KR) ..... 10-2002-0075313

(51) Int. Cl.

| | |
|---|---|
| ***D06F 35/00*** | (2006.01) |
| ***D06F 15/00*** | (2006.01) |
| ***D06F 29/00*** | (2006.01) |
| ***D06F 21/04*** | (2006.01) |

(52) U.S. Cl. ..... 68/23 A; 68/5 E; 68/24; 68/58; 68/139; 8/158; 8/159; 134/200

(58) Field of Classification Search ..... 68/5 E, 68/24, 23 A, 36, 23, 58, 139 A; 8/159; 134/200
See application file for complete search history.

(56) References Cited

U.S. PATENT DOCUMENTS

| | | | | |
|---|---|---|---|---|
| 4,026,565 | A * | 5/1977 | Jelinek | 277/639 |
| 5,881,579 | A * | 3/1999 | Ellingson | 68/24 |
| 6,256,823 | B1 * | 7/2001 | Kronbetter et al. | 8/158 |
| 6,442,981 | B1 * | 9/2002 | Augustsson | 68/139 |
| 2004/0025544 | A1 * | 2/2004 | Kim et al. | 68/3 R |
| 2006/0174663 | A1 * | 8/2006 | Cimetta et al. | 68/3 R |

* cited by examiner

*Primary Examiner*—Michael Barr
*Assistant Examiner*—Rita R Patel
(74) *Attorney, Agent, or Firm*—Birch, Stewart, Kolasch & Birch, LLP

(57) ABSTRACT

A gasket and drum washing machine using the same. The washing machine includes a cabinet having a first opening through which a laundry is put in the cabinet, a tub installed in the cabinet to have a second opening corresponding to the first opening, a drum installed in the tub to have a third opening corresponding to the second opening, and a gasket for preventing leakage of water. The gasket includes a leakage preventing part having one end connected to a rim of the first opening and the other end connected to a rim of the second opening to prevent water leakage, a deformation preventing part connected to the leakage preventing part, and a laundry-stuck preventing part provided on an inner circumference of the leakage preventing part to prevent the laundry from being stuck between the second and third openings.

16 Claims, 5 Drawing Sheets

GASKET AND WASHING MACHINE USING THE SAME

This application claims the benefit of Korean Application(s) No. 10-2002-0075313 filed on Nov. 29, 2002, which is/are hereby incorporated by reference.

BACKGROUND OF THE INVENTION

1. Field of the Invention

The present invention relates to a washing machine, and more particularly, to a gasket and drum type washing machine using the same, which prevents a laundry from being stuck in a laundry opening part.

2. Discussion of the Related Art

Generally, a washing machine holds water and detergent in a lower part of a tub. After laundry is put in a drum installed inside the tub, the drum is rotated to perform washing, rinsing, and dewatering.

Such a washing machine is an apparatus for eliminating dirt or filth attached to the laundry by applying a mechanical force thereto together with a detergent.

Specifically, a drum type washing machine is an apparatus for eliminating dirt or filth attached to the laundry by putting the laundry, water, and detergent in a drum horizontally installed to rotate by a driving force of a motor. The drum type washing machine barely has entanglement and damage of the laundry, consumes less water, and even has washing effects of beating and rubbing.

Referring to FIG. 1 and FIG. 2, a general drum type washing machine consists of a cabinet 10 forming an exterior to have a first opening 11 at a front side to put in/out a laundry, a door 12 installed in front of the cabinet 10 to open/close the first opening 11, a tub 20 provided inside the cabinet 10 to have a second opening 21 communicating with the first opening 11, and a drum 50 rotatably installed inside the tub 20 to have a third opening 50*a* communicating with the first opening 11.

In this case, the first to third openings 11, 21, and 50*a* construct an opening part through which the laundry is put in/out.

The drum 50 includes lifters 25 on its inside to pull the laundry up to a predetermined height. Once the drum 50 rotates, the laundry is lifted up to an upper part of the drum 50 by the lifters 25 and then falls down for washing.

A rotational means for rotating the drum is provided in a space between an inside of the cabinet 10 and the tub 20.

The rotational means consists of a motor 40 provided under the tub 20 to be electrically driven, a first rotational shaft 41 extending in a rear direction of the cabinet 10 to have one end connected to the motor 40, a driving pulley 42 provided at the other end of the first rotational shaft 41, a second rotational shaft 43 having one end connected to a rear side of the drum 50, a driven pulley 44 provided at the other end of the second rotational shaft 43, and a belt 45 connecting the driving and driven pulleys 42 and 44.

A rotational force of the motor 40 enabling forward and reverse rotations is transferred to the drum 50 via the two rotational shafts, driving pulley, belt, and driven pulley.

Meanwhile, a water supply hose 16, a water supply valve (not shown in the drawing), and a detergent box 17 for supplying water and detergent to the tub 20 are installed in an upper side of the cabinet 10. And, a drain pump 18 and a drain hose 19 for circulating or draining the water are installed under the tub 20.

A control panel 15 provided as a control means for controlling an operation of the drum type washing machine is installed on an upper front side of the cabinet 10.

Moreover, a gasket 50 is provided between the first and second openings 11 and 21 to buffer shocks generated from forward and reverse vibrations of the drum and to prevent leakage of the water when the drum is rotating with the door closed.

Referring to FIG. 3, the gasket 50 consists of a front end coupling part 51 enclosing the first opening 11 to be coupled with the first opening, a rear end coupling part 52 enclosing the second opening 21 to be coupled with the second opening 21, and a middle connecting part 53 of a flexible material connecting the front and rear end coupling parts 51 and 52.

The middle connecting part 53 consists of a first connecting member 53*a* having one end connected to the front end coupling part 51 to horizontally extend toward the tub, a second connecting member 53*b* having one end connected to the other end of the first connecting member 53*a* to radially extend toward the front side of the cabinet, and a third connecting member 53*c* having one end connected to the other end of the second connecting member 53*b* and having the other end connected to the rear end coupling part 52.

Thus, the middle connecting part 53 is bent to prevent shocks from appearing on the cabinet due to vibrations of the drum and tub when the washing machine is operating.

In this case, the first to third connecting members are formed uniform in thickness.

And, a ring type protrusion 54 protrudes from an inner circumference of the middle connecting part 53 to block a predetermined portion of a gap between the second and third openings 21 and 50*a*, thereby preventing the laundry from being stuck between the second and third openings 21 and 31.

However, in the general drum type washing machine, the above-constructed gasket becomes deformed if the washing machine holding quite amount of the laundry is left alone for a considerably long time or if the washing machine operates for a considerably long time.

Moreover, the vibrations of the tub and drum may result in the deformation of the gasket.

To overcome such a problem, a gasket and drum type washing machine using the same are needed to prevent deformation of the gasket even if the washing machine holding a massive amount of the laundry is left alone or used for a considerably long time.

SUMMARY OF THE INVENTION

Accordingly, the present invention is directed to a gasket and drum type washing machine using the same that substantially obviates one or more of the problems due to limitations and disadvantages of the related art.

An object of the present invention, which has been devised to solve the foregoing problem, lies in providing a gasket and drum type washing machine using the same, by which the laundry is prevented from being stuck in a laundry opening part between a cabinet and a drum.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided, in a washing machine including a cabinet having a first opening through which a laundry is put in on a cabinet front side, a tub having a second opening at a tub front side, and a drum rotatably installed in the tub to have a third opening at a drum front side, a gasket according to the present invention includes a leakage preventing part having one end connected to a rim of the first opening and the other end connected to a rim of the second opening to prevent water leakage wherein a portion between the one and the other ends of the leakage preventing part is bent to prevent shocks by vibrations of the tub and drum from appearing on the cabinet, a deformation preventing part connected to the leakage preventing part to reinforce a strength of the leakage preventing part and to prevent deformation of the leakage preventing part, and a laundry-stuck preventing part provided on an inner circumference of the leakage preventing part to prevent the laundry from being stuck between the second and third openings.

The deformation preventing part comprising at least one ring type rib protruding from an outer circumference of the leakage preventing part.

The leakage preventing part includes a first connecting member having one end connected to the first opening to horizontally extend toward the tub, a second connecting member having one end connected to the other end of the first connecting member to radially extend toward the cabinet front side, and a third connecting member having one end connected to the other end of the second connecting member and having the other end connected to the second opening.

The ring type rib is formed on at least one of outer circumferences of the first and second connecting members.

And, a connecting portion of the ring type rib with the leakage preventing part is preferably rounded.

In this case, a vertical cross-section of the ring type rib is hemi-circular or polygonal.

Meanwhile, the deformation preventing part is formed at a connecting part between the first and second connecting members and further comprises a strength gusset for reinforcing elasticity of the leakage preventing part.

In another aspect of the present invention, a drum type washing machine includes a cabinet having a first opening through which a laundry is put in at a cabinet front side wherein a door is installed to open/close the first opening, a tub installed in the cabinet to have a second opening at a tub front side corresponding to the first opening, a drum installed in the tub to have a third opening at a drum front side corresponding to the second opening, a rotation mans having a rotational shaft penetrating a rear side of the tub to be connected to the drum, and a gasket for preventing leakage of water.

The gasket includes a leakage preventing part having one end connected to a rim of the first opening and the other end connected to a rim of the second opening to prevent water leakage wherein a portion between the one and the other ends of the leakage preventing part is bent to prevent shocks by vibrations of the tub and drum from appearing on the cabinet, a deformation preventing part connected to the leakage preventing part to reinforce a strength of the leakage preventing part and to prevent deformation of the leakage preventing part, and a laundry-stuck preventing part provided on an inner circumference of the leakage preventing part to prevent the laundry from being stuck between the second and third openings.

The deformation preventing part includes at least one ring type rib protruding from an outer circumference of the leakage preventing part.

Therefore, the above-constructed drum type washing machine according to the present invention enables to prevent water leakage and deformation of the gasket despite shocks or long-time use.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
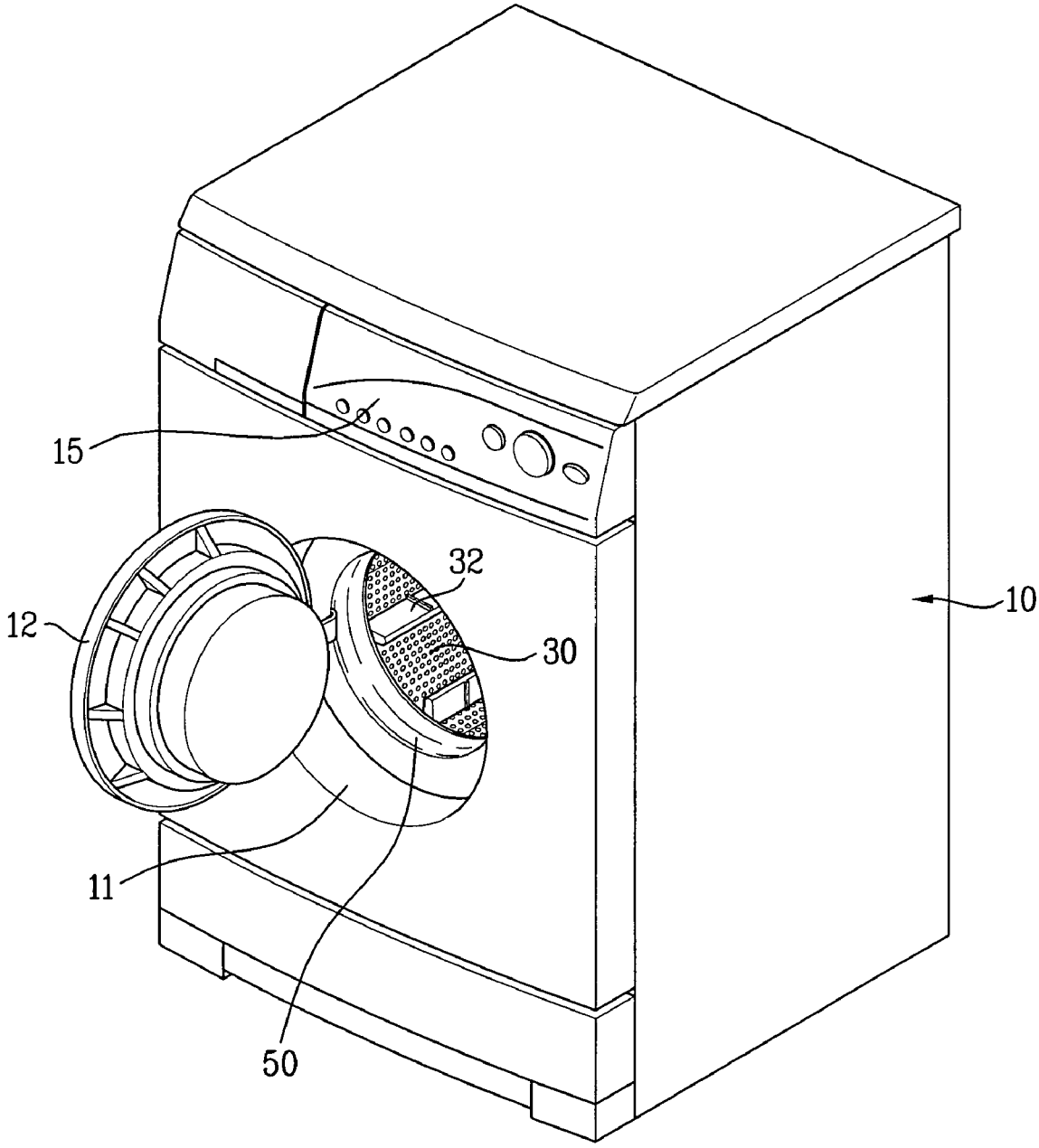
FIG. 1 is a perspective view of a general drum type washing machine.
Figure 2:
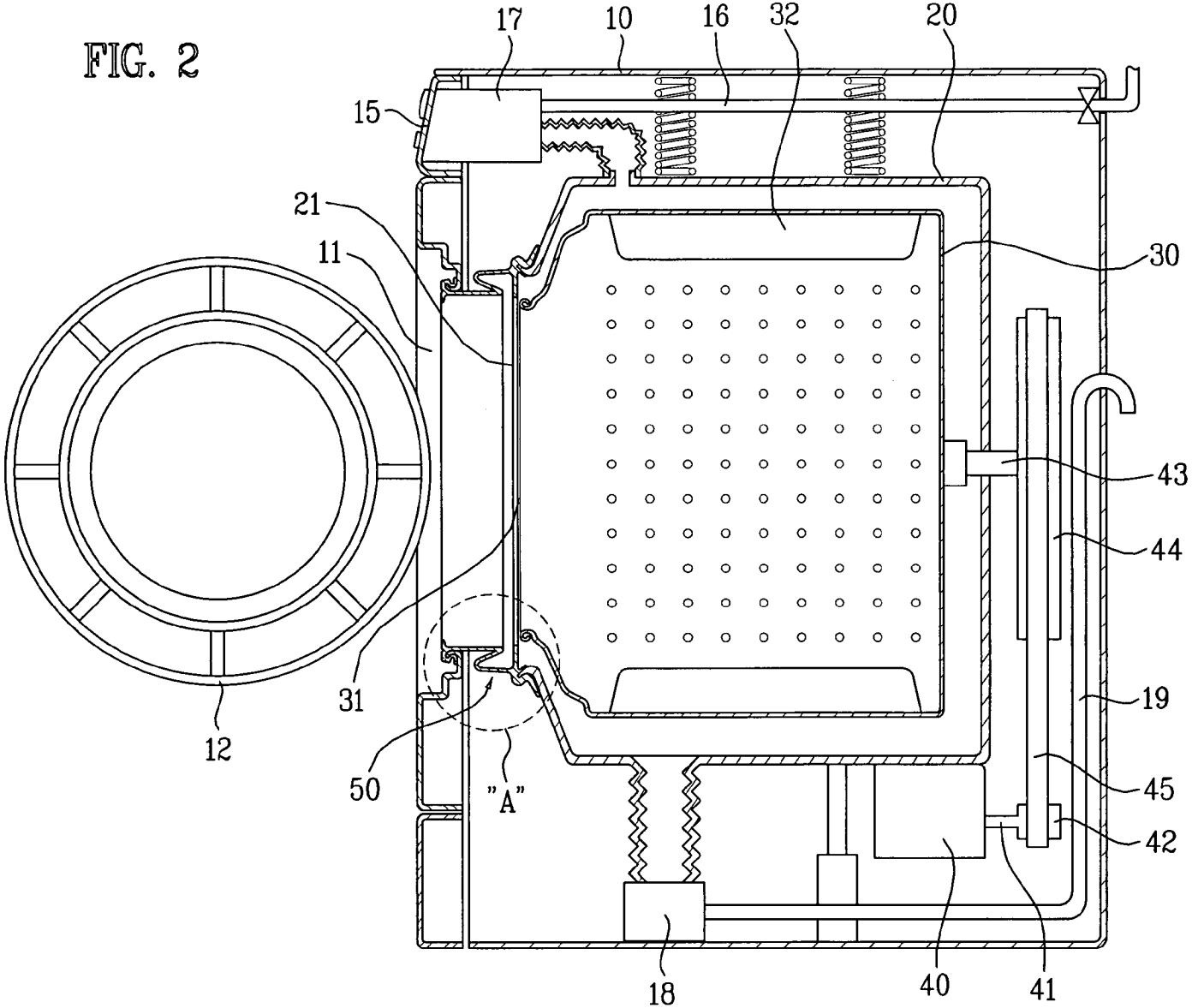
FIG. 2 is a schematic internal view of a general drum type washing machine.
Figure 3:
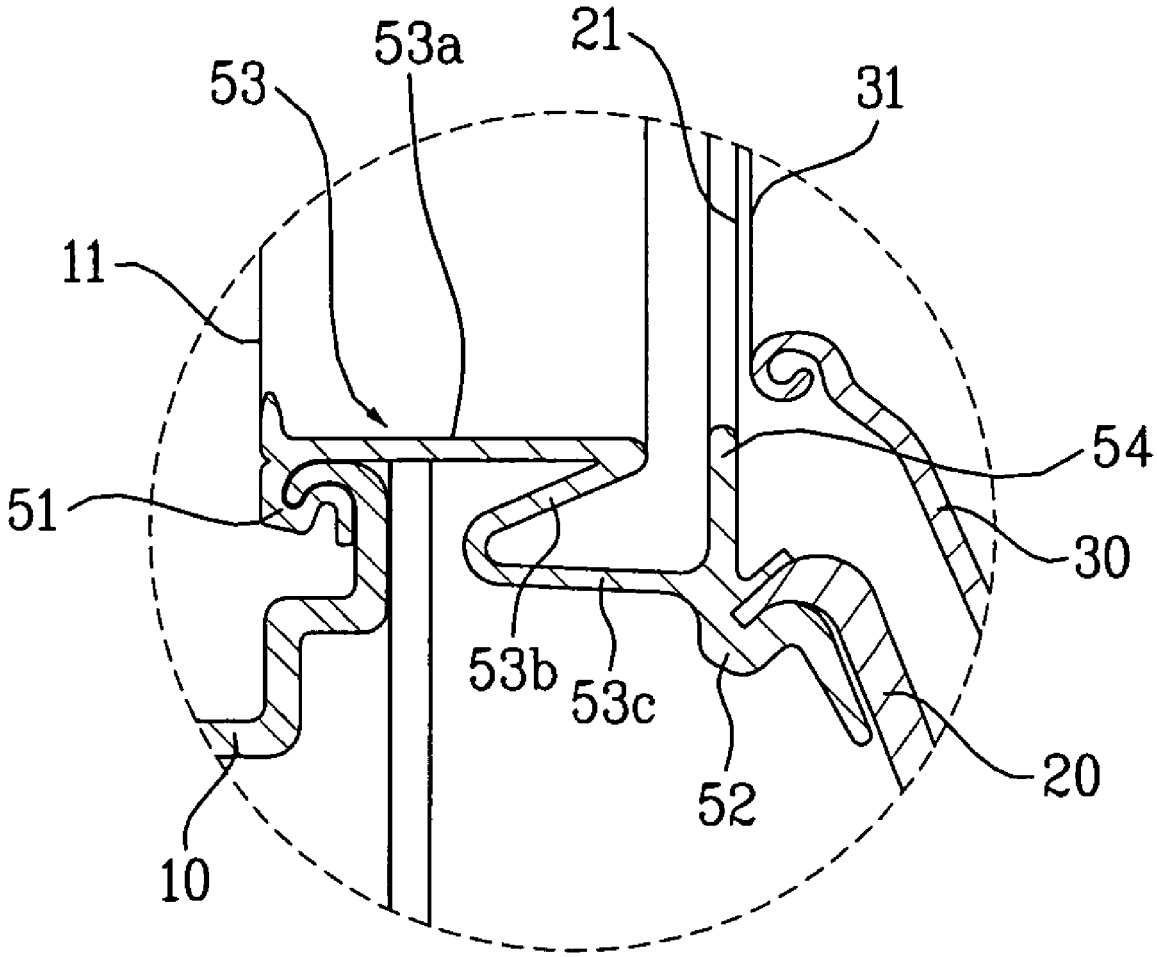
FIG. 3 is a magnified view of 'A' in FIG. 2.
Figure 4:
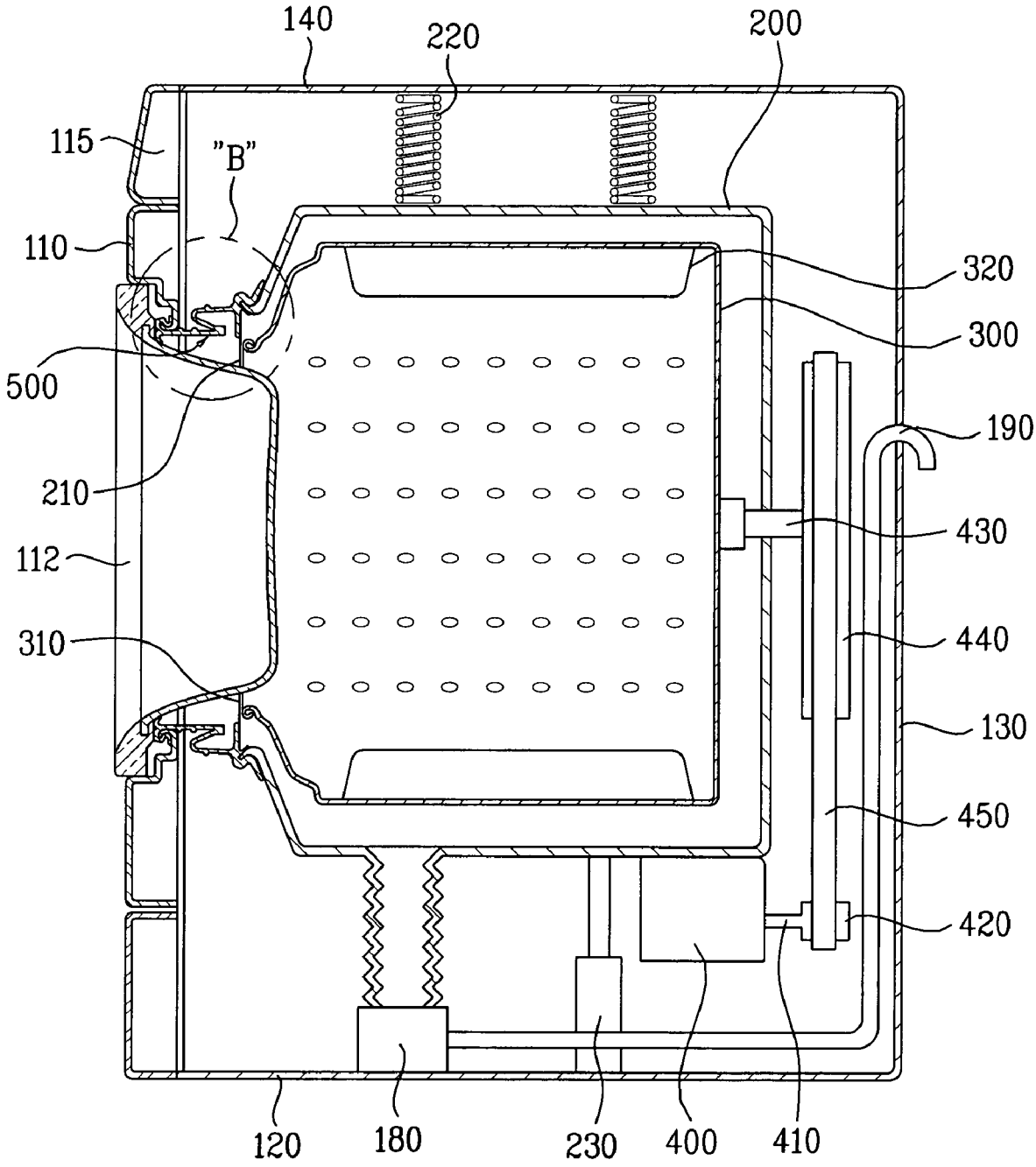
FIG. 4 is a schematic internal view of a drum type washing machine according to one embodiment of the present invention.
Figure 5:
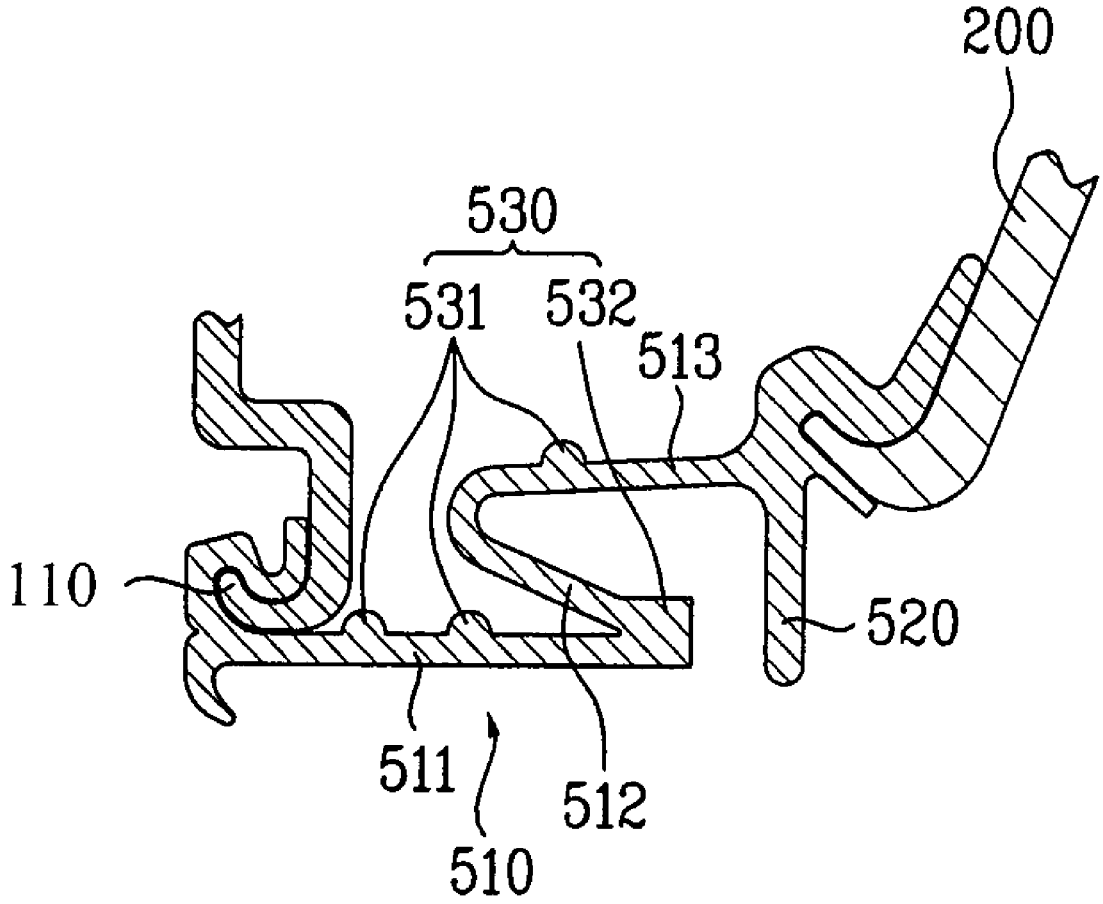
FIG. 5 is a magnified view of 'B' in FIG. 4.

FIG. 4 is a schematic internal view of a drum type washing machine according to one embodiment of the present invention and FIG. 5 is a magnified view of 'B' in FIG. 4.

Referring to FIG. 4 and FIG. 5, a drum type washing machine according to one preferred embodiment of the present invention includes a cabinet 100 forming an exterior, a tub 200 provided in the cabinet, a drum 300 rotatably provided in the tub 200, and a rotation means for rotating the drum 300.

The cabinet 100 includes a base plate 120 installed at a bottom, a pair of side plates (not shown in the drawing) provided on both sides of the base plate 120, a rear plate 130 provided in rear of the side plates, a front plate 110 provided in front of the base and side plates, and a top plate 140 provided on the side, rear, and front plates.

A first opening 111 through which a laundry is put in/out is formed at a center of the front plate 110. And, a door 112 is installed at the front plate 110 to open/close the first opening 111 and to prevent the laundry from being thrown away through the first opening 111.

A control panel 115 controlling an operation of the drum type washing machine is installed on an upper front side of the top plate 150.

A second opening 210 is formed at a front side of the tub 200 to correspond to the first opening 111 of the front plate 110 and to communicate with the first opening 111.

And, an elastic means 220 and a damper 230 are formed over and under the tub 200, respectively to attenuate a vibration generated from an operation of the washing machine.

A gasket 500 is installed between the door 112 and the tub 200 to alleviate a shock generated from rotation of the drum 300 and to play a role of a packing for preventing water from leaking outside.

The drum 300 includes lifters 320 on its inside to pull up the laundry to a predetermined height and a third opening 310 at its front side to correspond to the second opening 210.

Once the drum 300 rotates, the laundry is firstly lifted up to an upper part of the drum by the lifters 320 and then falls downward to perform washing.

And, the third opening 310 is provided as an entrance through which the laundry having put in via the first and second openings 111 and 210 finally enters the drum 300.

The above-described first to third openings construct an opening part through which the laundry is put in the drum from the front side of the cabinet.

The rotational means consists of a motor 400 provided under the tub to be electrically driven, a first rotational shaft 410 extending in a rear direction of the cabinet to have one end connected to the motor 400, a driving pulley 420 provided at the other end of the first rotational shaft 410, a second rotational shaft 430 having one end connected to a rear side of the drum, a driven pulley 440 provided at the other end of the second rotational shaft 430, and a belt 450 connecting the driving and driven pulleys 420 and 440.

A rotational force of the motor 400 enabling forward and reverse rotations is transferred to the drum 300 via the two rotational shafts 410 and 430, driving pulley 420, belt 450, and driven pulley 440.

Meanwhile, a drain pump 180 and a drain hose 190 for circulating or draining the water are installed at one inner side of the cabinet 100 under the tub 200.

The gasket 500 according to one embodiment of the present invention is explained in detail by referring to FIG. 5 as follows.

In the embodiment according to the present invention, an inside diameter of the second opening 210 is formed greater than that of the third opening 310.

Moreover, the second opening 210 is formed ahead of the third opening 310.

The gasket 500 prevents shocks caused by the vibrations of the tub and drum from appearing on the front side of the cabinet 100, blocks a gap between the first and second openings 111 and 210 to prevent leakage of the water, and prevents the laundry from being stuck in a space between the first and third openings 210 and 310.

Specifically, the gasket 500 includes a leakage preventing part 510 having one end connected to a rim of the first opening 111 and the other end connected to a rim of the second opening 210 wherein a part between the one and the other ends is bent to prevent the shocks by the tub and drum, a laundry-stuck preventing part 520 provided on an inner circumference of the leakage preventing part 510 to prevent the laundry from being stuck in the space between the second and third openings 210 and 310, and a deformation preventing part 530 having one end connected to the leakage preventing part 510 to reinforce a strength of the leakage preventing part 520 and to prevent deformation.

The leakage preventing part 510 includes the one end enclosing the rim of the first opening 111 and the other end enclosing the rim of the second opening 210.

Specifically, the leakage preventing part 510 is formed of a flexible material, and includes a first connecting member 511 having one end enclosing to be connected to the rim of the first opening to horizontally extend toward the tub, a second connecting member 512 having one end connected to the other end of the first connecting member 511 to radially extend toward the front side of the cabinet, and a third connecting member 513 having one end connected to the other end of the second connecting member 512 and having the other end enclosing to be connected to the second opening 210.

Thus, the leakage preventing part 510 is bent to prevent shocks from appearing on the cabinet due to vibrations of the drum and tub when the washing machine is operating.

The laundry-stuck preventing part 520 includes a ring type protrusion 521 protruding from an inner circumference of the third connecting member 513 toward the third opening 310 to prevent the laundry from being stuck between the drum and the respective openings 111, 210.

The deformation preventing part 530 includes at least one ring type rib 531 protruding along an outer circumference of the leakage preventing part 510.

Preferably, the ring type ribs 531 are plurally formed on outer circumferences of the first and third connecting members 511 and 513 in a circumferential direction.

Preferably, a connecting portion of the ring type rib 531 to the leakage preventing part 510 has a round shape (not shown in the drawing).

Besides, a vertical cross-section of the ring type rib 531 may have one of shapes such as hemi-circle, triangle, rectangle, and polygons.

Meanwhile, the deformation preventing part 530 is formed at a connecting part between the first and second connecting members 511 and 513, and further includes a strength gusset 532 for reinforcing elasticity of the leakage preventing part 510.

An operation of the above-constructed drum type washing machine according to the present invention is explained as follows.

First of all, a user opens the door 112, puts an appropriate amount of laundry in the drum 300 via the first opening 111, closes the door 112, puts water and detergent, selects an appropriate washing course, and then initiates an operation of a washing step.

In this case, the laundry having been put in the drum 300 is repeatedly lifted up and falls down so that the washing is performed.

After completion of the washing step, a dewatering step is executed. The dewatering step is performed in a manner that the drum 300 rotates a high speed to separate water contents from the laundry by a centrifugal force.

While the washing or dewatering is in progress, the gasket 500 sustains the weight for a considerably long time as well as alleviates the shocks caused by the vibrations of the tub and drum.

For which, the ring type rib 531 and the strength gusset 532 of the deformation preventing part 530 are provided to prevent the deformation of the leakage preventing part 510.

Accordingly, the present invention has the following advantages or effects.

First of all, the present invention prevents the deformation of the gasket even if the washing machine holding the laundry is operated for a long time.

Secondly, the present invention prevents the gasket from being damaged by the shocks generated from the drum and tub.

Thirdly, the present invention reinforces the elasticity of the gasket to greatly alleviate the vibrations generated from the drum and tub.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. In a washing machine including a cabinet having a first opening through which laundry is put in on a cabinet front side, a tub having a second opening at a tub front side, and a drum rotatably installed in the tub to have a third opening at a drum front side, a gasket comprising:

a leakage preventing part having one end connected to a rim of the first opening and the other end connected to a rim of the second opening to prevent water leakage wherein a portion between the one and the other ends of the leakage preventing part is bent to prevent shocks by vibrations of the tub and drum from appearing on the cabinet, the leakage preventing part including:

a first connecting member having one end connected to the first opening to horizontally extend toward the tub;

a second connecting member having one end connected to the other end of the first connecting member to radially extend toward the cabinet front side; and a third connecting member having one end connected to the other end of the second connecting member and having the other end connected to the second opening, wherein the first, second, and third member are formed as a continuous member;

a deformation preventing part connected to the leakage preventing part to reinforce a strength of the leakage preventing part and to prevent deformation of the leakage preventing part, wherein the deformation preventing part is formed at a connecting part between the first and second connecting members and further comprises a strength gusset for reinforcing elasticity of the leakage preventing part; and a laundry-stuck preventing part extending inwardly from an interior side of the leakage preventing part around an entire inner circumference of the leakage preventing part to prevent the laundry from being stuck between the second and third openings.

2. The gasket as claimed in claim 1, the deformation preventing part comprising at least one ring rib protruding from an outer circumference of the leakage preventing part.

3. The gasket as claimed in claim 2, wherein the ring rib is formed on at least one of outer circumferences of the first and second connecting members.

4. The gasket as claimed in claim 3, wherein a connecting portion of the ring rib with the leakage preventing part is rounded.

5. The gasket as claimed in claim 3, wherein a vertical cross-section of the ring rib is semicircular.

6. The gasket as claimed in claim 3, wherein a vertical cross-section of the ring rib is polygonal.

7. A drum washing machine comprising:

a cabinet having a first opening through which laundry is put in at a cabinet front side wherein a door is installed to open/close the first opening;

a tub installed in the cabinet to have a second opening at a tub front side corresponding to the first opening;

a drum installed in the tub to have a third opening at a drum front side corresponding to the second opening;

a rotation means having a rotational shaft penetrating a rear side of the tub to be connected to the drum; and a gasket for preventing leakage of water, the gasket comprising:

a leakage preventing part having one end connected to a rim of the first opening and the other end connected to a rim of the second opening to prevent water leakage wherein a portion between the one and the other ends of the leakage preventing part is bent to prevent shocks by vibrations of the tub and drum from appearing on the cabinet, the leakage preventing part including:

a first connecting member having one end connected to the first opening to horizontally extend toward the tub;

a second connecting member having one end connected to the other end of the first connecting member to radially extend toward the cabinet front side; and a third connecting member having one end connected to the other end of the second connecting member and having the other end connected to the second openings, wherein the first, second, and third member are formed as a continuous member;

a deformation preventing part connected to the leakage preventing part to reinforce a strength of the leakage preventing part and to prevent deformation of the leakage preventing part, wherein the deformation preventing part is formed at a connecting part between the first and second connecting members and further comprises a strength gusset for reinforcing elasticity of the leakage preventing part; and a laundry-stuck preventing part extending inwardly from an interior side of the leakage preventing part around an entire inner circumference of the leakage preventing part to prevent the laundry from being stuck between the second and third openings.

8. The drum washing machine as claimed in claim 7, the deformation preventing part comprising at least one ring rib protruding from an outer circumference of the leakage preventing part.

9. The drum washing machine as claimed in claim 8, wherein the ring rib is formed on at least one of outer circumferences of the first and second connecting members.

10. The drum washing machine as claimed in claim 9, wherein a connecting portion of the ring rib with the leakage preventing part is rounded.

11. The drum washing machine as claimed in claim 9, wherein a vertical cross-section of the ring rib is semi-circular.

12. The drum washing machine as claimed in claim 9, wherein a vertical cross-section of the ring rib is polygonal.

13. The gasket as claimed in claim 1, wherein the laundry-stuck preventing part is uniformly shaped along the entire inner circumference of the leakage preventing part.

14. The drum washing machine as claimed in claim 7, wherein the laundry-stuck preventing part is uniformly shaped along the entire inner circumference of the leakage preventing part.

15. The gasket as claimed in claim 1, wherein the deformation preventing part is formed on an exposed portion of the leakage preventing part.

16. The drum washing machine as claimed in claim 7, wherein the deformation preventing part is formed on an exposed portion of the leakage preventing part.

* * * * *